US007773043B1

(12) United States Patent
Horner et al.

(10) Patent No.: US 7,773,043 B1
(45) **Date of Patent: *Aug. 10, 2010**

(54) VARIABLE ASPECT RATIO TAPERED SLOT ANTENNA FOR INCREASED DIRECTIVITY AND GAIN

(75) Inventors: Rob Horner, San Diego, CA (US); Rod Cozad, San Diego, CA (US); Hale Simonds, San Diego, CA (US); Robbi Mangra, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/706,678

(22) Filed: Feb. 8, 2007

(51) Int. Cl.
*H01Q 13/00* (2006.01)

(52) U.S. Cl. ..... 343/767; 343/768; 343/770; 343/771

(58) Field of Classification Search ..... 343/770, 343/767, 768, 771
See application file for complete search history.

(56) References Cited

U.S. PATENT DOCUMENTS

| | | | | |
|---|---|---|---|---|
| 7,009,572 | B1 * | 3/2006 | Homer et al. | 343/767 |
| 7,692,596 | B1 * | 4/2010 | Horner et al. | 343/767 |
| 2002/0180655 | A1 * | 12/2002 | Mohuchy et al. | 343/770 |
| 2007/0152898 | A1 * | 7/2007 | Mizuno et al. | 343/767 |

OTHER PUBLICATIONS

Rainee N. Simons and Richard Q. Lee, Linearly Tapered Slot Antenna Radiation Characteristics at Millimeter-Wave Frequency, NASA/TM-1998-207413, Jun. 1998, pp. 1-5.*

Rizk et al., IEEE Transactions on Antennas and Propagation, vol. 50, No. 3, Mar. 2002.*

* cited by examiner

*Primary Examiner*—Douglas W Owens
*Assistant Examiner*—Dieu Hien T Duong
(74) *Attorney, Agent, or Firm*—Arthur K. Samora; Kyle Eppele

(57) ABSTRACT

A Variable Aspect Ratio Tapered Slot Antenna For Increased Directivity And Gain (NC#98102). The apparatus includes a tapered slot antenna having a length and a height, and having an aspect ratio greater than or equal to 2.5. The tapered slot antenna includes a first antenna element comprising conductive material and configured to receive and transmit RF signals; and a second antenna element comprising conductive material, operatively coupled to said first antenna element, configured to receive and transmit RF signals.

6 Claims, 3 Drawing Sheets

Front View (Note: FIGS 1A-1B are NOT drawn to scale)

Side View

200
Z
X
Y
210
294
220
272
262
Front View

246
L
242
244
M
N
N
210
220
(Note: FIGS 2A-2B are NOT drawn to scale)
254
214
224
Side View

K
K
240
L
294
M
200
Z
X
Y

300

VARIABLE ASPECT RATIO TAPERED SLOT ANTENNA FOR INCREASED DIRECTIVITY AND GAIN

FEDERALLY SPONSORED RESEARCH AND DEVELOPMENT

This invention (Navy Case No. 98102) is assigned to the United States Government and is available for licensing for commercial purposes. Licensing and technical inquiries may be directed to the Office of Research and Technical Applications, Space and Naval Warfare Systems Center, San Diego, Code 2112, San Diego, Calif., 92152; voice (619) 553-2778; email T2@spawar.navy.mil. Reference Navy Case Number 98102.

CROSS-REFERENCE TO RELATED APPLICATIONS

This application is related to U.S. Pat. No. 7,009,572, issued on Mar. 7, 2006, entitled "Tapered Slot Antenna", by Rob Horner et al., Navy Case No. 96507, which is hereby incorporated by reference in its entirety herein for its teachings on antennas. This application is also related to U.S. Ser. No. 10/932,646 filed on Aug. 31, 2004, entitled "Concave Tapered Slot Antenna", by Rob Horner et al., Navy Case No. 96109, which is hereby incorporated by reference in its entirety herein for its teachings on antennas.

BACKGROUND OF THE INVENTION

The present invention is generally in the field of antennas.

Typical tapered slot antennas have average directivity and gain. FIG. 1A is a side view of a typical tapered slot antenna (TSA). As shown in FIG. 1A, TSA 100 includes an antenna pair (i.e., antenna element 110 and antenna element 120) comprising conductive material. The antenna pair of TSA 100 has gap height 194, a feed end and a launch end. The feed end of the antenna pair corresponds to the portion of the antenna pair that is proximate to axis 140 (represented by dashed line K-K on FIG. 1A). The feed end receives and transmits signals. The launch end of the antenna pair corresponds to the portion of the antenna pair that is proximate to axis 146 (represented by dashed line N-N on FIG. 1A). Note that the launch end only denotes a location on the antenna pair versus an actual launch point of a particular frequency. Antenna element (AE) 110 has lateral edge 114, which corresponds to the portion of AE 110 that is proximate to axis 142 (represented by dashed line L-L on FIG. 1A). Antenna element 120 has lateral edge 124, which corresponds to the portion of AE 120 that is proximate to axis 144 (represented by dashed line M-M on FIG. 1A).

Typical TSA have an aspect ratio (i.e., length to height ratio) that is equal to 1. TSA length 154 of TSA 100 is defined as the distance between the feed end (proximate to axis 140) and the launch end (proximate to axis 146). TSA height 162 of TSA 100 is defined as the distance between the lateral edges of the antenna pair (i.e., the distance between lateral edge 114 and lateral edge 124) (i.e., the distance between axis 142 and axis 144). Thus, the aspect ratio of TSA 100 (i.e., ratio between TSA length 154 and TSA height 162) is equal to 1.

FIG. 1B is a front view of one embodiment of a typical TSA. TSA 100 of FIG. 1B is substantially similar to TSA 100 of FIG. 1A, and thus, similar components are not described again in detail hereinbelow. As shown in FIG. 1B, TSA 100 includes an antenna pair (i.e., antenna element 110, antenna element 120). The antenna pair of TSA 100 has gap height 194. TSA 100 has TSA width 172.

A need exists for tapered slot antennas having increased directivity and gain.

DETAILED DESCRIPTION OF THE INVENTION

The present invention is directed to Variable Aspect Ratio Tapered Slot Antenna For Increased Directivity And Gain.

Definitions

The following acronyms and definitions are used herein:

Acronym(s):

I/O—Input/Output

RF—radio frequency

TSA—Tapered Slot Antenna

VAR—Variable Aspect Ratio

Definition(s)

Aspect ratio—the ratio between the length and height of a TSA

The variable aspect ratio (VAR) tapered slot antenna for increased directivity and gain includes a TSA having an aspect ratio greater than or equal to 2.5. The VAR TSA for increased directivity and gain includes an antenna pair.

Figure 1B:
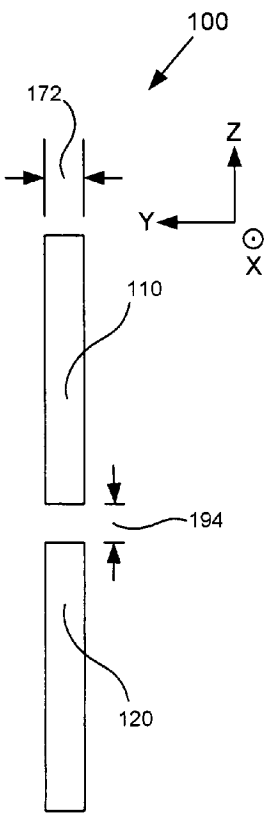
FIG. 1B (PRIOR ART)
FIG. 1B is a front view of a typical tapered slot antenna (PRIOR ART).
Figure 1A:
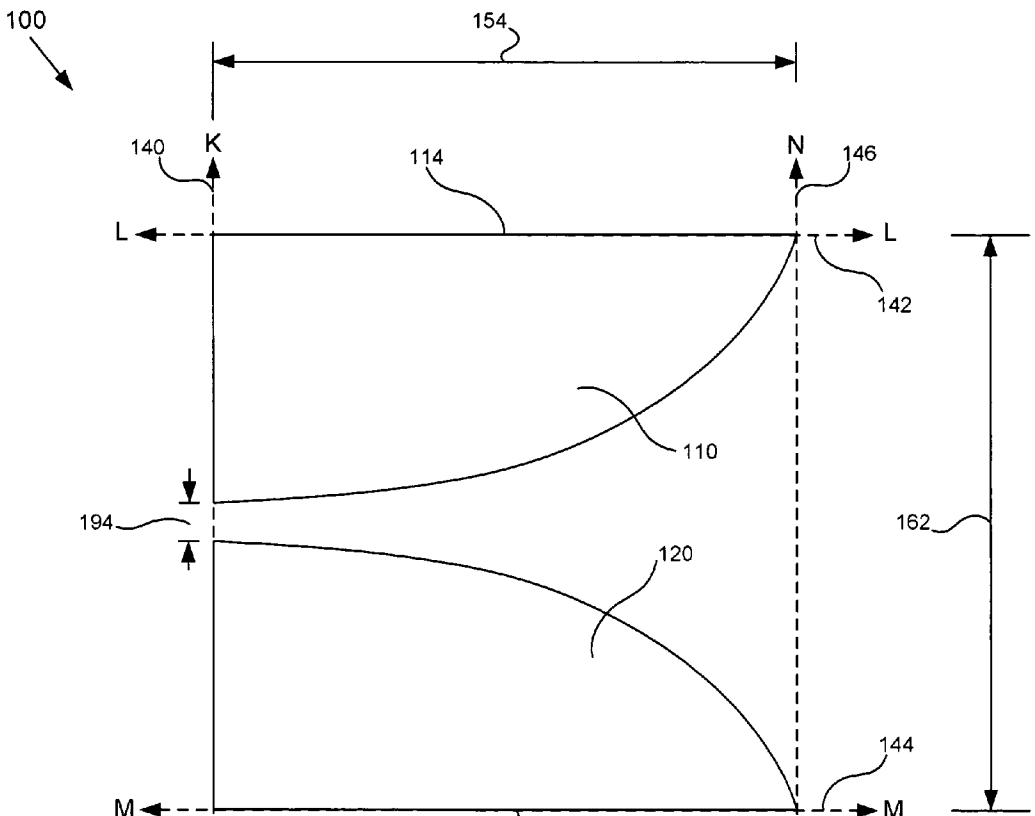
FIG. 1A (PRIOR ART)
FIG. 1A is a side view of a typical tapered slot antenna (PRIOR ART).
Figures 2A, 2B:
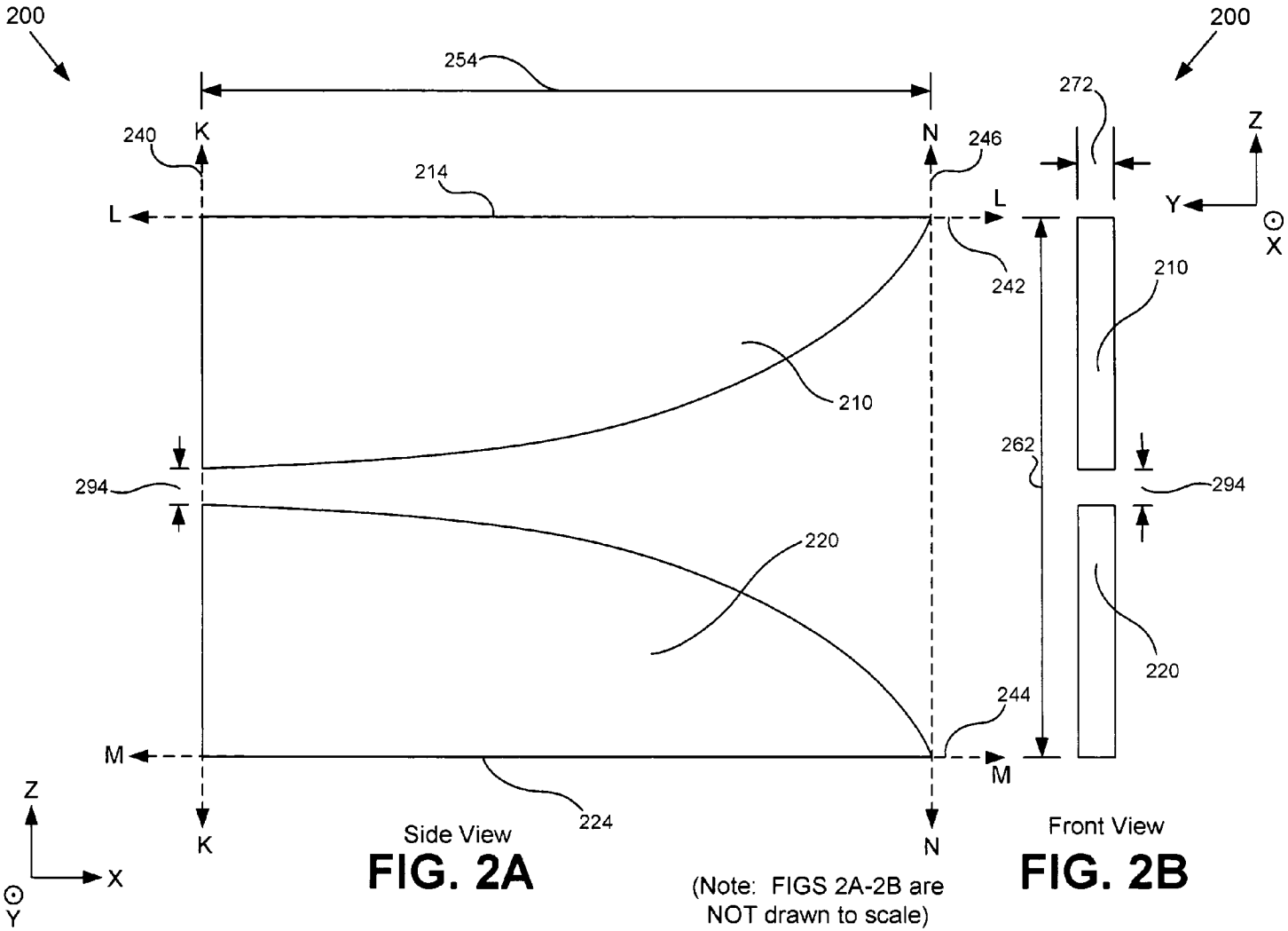
FIG. 2A is a side view of one embodiment of a variable aspect ratio tapered slot antenna.
FIG. 2B is a front view of one embodiment of a variable aspect ratio tapered slot antenna.

FIG. 2A is a side view of one embodiment of a variable aspect ratio tapered slot antenna for increased directivity and gain. As shown in FIG. 2A, VAR TSA for increased directivity and gain 200 includes an antenna pair (i.e., antenna element 210 and antenna element 220) comprising conductive material. The antenna pair of VAR TSA for increased directivity and gain 200 has gap height 294, a feed end and a launch end. The feed end of the antenna pair corresponds to the portion of the antenna pair that is proximate to axis 240 (represented by dashed line K-K on FIG. 2A). The feed end receives and transmits signals. The launch end of the antenna pair corresponds to the portion of the antenna pair that is proximate to axis 246 (represented by dashed line N-N on FIG. 2A). Note that the launch end only denotes a location on the antenna pair versus an actual launch point of a particular frequency. The feed end can be operatively coupled to an input/output (I/O) feed such as a coaxial cable. An I/O feed can be used to transmit and receive RF signals to and from VAR TSA for increased directivity and gain 200. RF signals can be transmitted from the feed end toward the launch end, wherein the RF signals launch from the antenna pair at a point between the feed end and the launch end depending on the signal frequency. Antenna element 210 has lateral edge 214, which corresponds to the portion of AE 210 that is proximate to axis 242 (represented by dashed line L-L on FIG. 2A).

Antenna element 220 has lateral edge 224, which corresponds to the portion of AE 220 that is proximate to axis 244 (represented by dashed line M-M on FIG. 2A).

In one embodiment, TSA antenna elements 210, 220 have curvatures that can each be represented by the following Equation 1:

$$Y(x)=a(e^{bx}31\ 1) \qquad \text{(Equation 1);}$$

where, a and b are parameters selected to produce a desired curvature. In one embodiment, parameters "a" and "b" are approximately equal to 0.2801 and 0.1028, respectively.

VAR TSA for increased directivity and gain 200 has an aspect ratio (i.e., length to height ratio) that is greater than or equal to 2.5. In one embodiment, VAR TSA for increased directivity and gain 200 has an aspect ratio greater than or equal to 3. In one embodiment, VAR TSA for increased directivity and gain 200 has an aspect ratio greater than or equal to 3.5. In one embodiment, VAR TSA for increased directivity and gain 200 has an aspect ratio greater than or equal to 4. In one embodiment, VAR TSA for increased directivity and gain 200 has an aspect ratio greater than or equal to 4.5. In one embodiment, VAR TSA for increased directivity and gain 200 has an aspect ratio greater than or equal to 5. In one embodiment, VAR TSA for increased directivity and gain 200 has an aspect ratio greater than or equal to 5.5. In one embodiment, VAR TSA for increased directivity and gain 200 has an aspect ratio greater than or equal to 6. In one embodiment, VAR TSA for increased directivity and gain 200 has an aspect ratio greater than or equal to 6.5. In one embodiment, VAR TSA for increased directivity and gain 200 has an aspect ratio greater than or equal to 7. In one embodiment, VAR TSA for increased directivity and gain 200 has an aspect ratio greater than or equal to 7.5. In one embodiment, VAR TSA for increased directivity and gain 200 has an aspect ratio greater than or equal to 8. In one embodiment, VAR TSA for increased directivity and gain 200 has an aspect ratio greater than or equal to 8.5. In one embodiment, VAR TSA for increased directivity and gain 200 has an aspect ratio greater than or equal to 9. In one embodiment, VAR TSA for increased directivity and gain 200 has an aspect ratio greater than or equal to 9.5. In one embodiment, VAR TSA for increased directivity and gain 200 has an aspect ratio greater than or equal to 10. In one embodiment, VAR TSA for increased directivity and gain 200 has an aspect ratio greater than or equal to 10.5. In one embodiment, VAR TSA for increased directivity and gain 200 has an aspect ratio greater than or equal to 11. In one embodiment, VAR TSA for increased directivity and gain 200 has an aspect ratio greater than or equal to 11.5. In one embodiment, VAR TSA for increased directivity and gain 200 has an aspect ratio greater than or equal to 12. TSA length 254 of VAR TSA for increased directivity and gain 200 is defined as the distance between the feed end (proximate to axis 240) and the launch end (proximate to axis 246). TSA height 262 of VAR TSA for increased directivity and gain 200 is defined as the distance between the lateral edges of the antenna pair (i.e., the distance between lateral edge 214 and lateral edge 224) (i.e., the distance between axis 242 and axis 244). Thus, the aspect ratio of VAR TSA for increased directivity and gain 200 (i.e., ratio between TSA length 254 and TSA height 262) is greater than or equal to 2.5. In one embodiment, TSA length 254 equals 2.5 feet and TSA height equals 1 foot. In one embodiment, TSA length 254 equals 5 feet and TSA height equals 2 feet.

FIG. 2B is a front view of one embodiment of a VAR TSA for increased directivity and gain. VAR TSA for increased directivity and gain 200 of FIG. 2B is substantially similar to VAR TSA for increased directivity and gain 200 of FIG. 2A, and thus, similar components are not described again in detail hereinbelow. As shown in FIG. 2B, VAR TSA for increased directivity and gain 200 includes an antenna pair (i.e., antenna element 210, antenna element 220). The antenna pair of VAR TSA for increased directivity and gain 200 has gap height 294. VAR TSA for increased directivity and gain 200 has TSA width 272.

The VAR is the ratio of the overall antenna length 254 (which is equal to the antenna element length) over the overall antenna height 262 (which is equal to the combined maximum heights of both antenna elements plus the distance of gap height 294 between the two antenna elements, as shown in FIGS. 2A and 2B). In addition to increasing the VAR as described above, the VAR can selectively manipulated by varying the ratio of overall length 254 to overall height 262. For example, selectively decreasing the VAR by decreasing overall length 254 (or by increasing overall height 262) will result in a TSA with decreased directivity and gain, but with an extended lower frequency response. In this manner, many different applications can be achieved by varying the overall length 254 and overall height 262 of the ISA, provided the antenna elements have the curvature described above.

Figure 3:
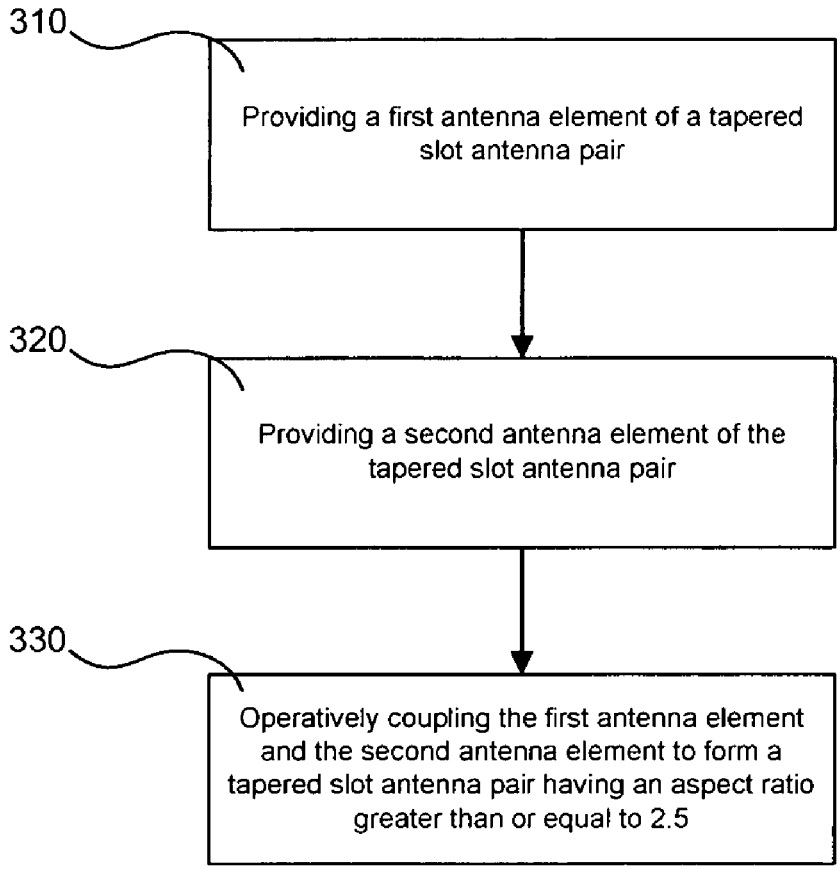
FIG. 3 is a flowchart of an exemplary method of manufacturing one embodiment of a variable aspect ratio tapered slot antenna.

FIG. 3 is a flowchart illustrating an exemplary process to implement an exemplary VAR TSA for increased directivity and gain. While boxes 310 through 330 shown in flowchart 300 are sufficient to describe one embodiment of an exemplary TSACA, other embodiments of the TSACA may utilize procedures different from those shown in flowchart 300.

We claim:

1. A tapered slot antenna, comprising:

a first antenna element and a second antenna element, said first antenna element and said second antenna element each having a feed end and a launch end and an element length equal to the distance between said feed end and said launch end, each first element length equal to said second element length, each said antenna element comprising conductive material and being configured to receive and transmit RF signals;

said tapered slot antenna further having an overall length equal to said element length;

each said antenna element having a lateral edge and a curved edge, said curved edge having a curvature defined by the equation $Y(x)=a(e^{bx}-1)$, where a and b are parameters selectively predetermined to maximize performance of said antenna, said antenna elements being arranged proximate each other to define a gap between said curved edges, said tapered slot antenna further having an overall height equal to the distance between said lateral edges and an aspect ratio defined by said overall length over said overall height; and, wherein said aspect ratio is selectively increased to maximize antenna gain.

2. The antenna of claim 1, wherein said aspect ratio is greater than or equal to 2.5.

3. A method for maximizing performance of an antenna comprising the steps of:

A) providing a pair of antenna elements of conductive material, said antenna elements both having equal element lengths and element heights;

B) forming at least one curved edge in each of said antenna elements, said curved edge having a curvature defined by the equation $Y(x)=a(e^{bx}-1)$, where a and b are parameters selectively predetermined to maximize performance of said antenna; and, C) arranging said antenna elements to define a slot therebetween, said slot being measured by a gap height, and to further define an overall length and an overall height for said antenna, said overall length being equal to said element length, said overall height corresponding to a total of both said element heights plus said gap height, and to define an aspect ratio of said overall length over said overall height; and, D) manipulating said aspect ratio to selectively maximize performance characteristics of said antenna.

4. The method of claim 3 wherein said step D) is accomplished by increasing said overall length to increase said aspect ratio, which provides for increased gain and directivity for said antenna.

5. The method of claim 3 wherein said step D) is accomplished by increasing said overall height to decrease said aspect ratio, which allows for increased performance of said antenna at lower frequencies.

6. The method of claim 3 wherein said step D) is accomplished by decreasing said overall length to decrease said aspect ratio, which allows for increased performance of said antenna at lower frequencies.

* * * * *